United States Patent [19]

Paoluccio

[11] Patent Number: 4,616,620

[45] Date of Patent: Oct. 14, 1986

[54] CONTAMINATION CONTROL APPARATUS

[76] Inventor: John A. Paoluccio, 3530 Kiernan St., Modesto, Calif. 95356

[21] Appl. No.: 777,557

[22] Filed: Sep. 17, 1985

Related U.S. Application Data

[63] Continuation of Ser. No. 551,360, Nov. 14, 1983, abandoned.

[51] Int. Cl.[4] ..... F02M 25/06

[52] U.S. Cl. ..... 123/573; 123/572; 123/574; 123/41.86

[58] Field of Search ..... 123/572, 573, 574, 41.86

[56] References Cited

U.S. PATENT DOCUMENTS

| | | | |
|---|---|---|---|
| 1,806,553 | 5/1931 | Babitch | 123/41.86 |
| 2,029,216 | 1/1936 | Barker | 123/41.86 |
| 2,585,495 | 2/1952 | Phillips | 123/41.86 |
| 2,639,701 | 5/1953 | Bales | 123/41.86 |
| 3,779,221 | 12/1973 | Gartner | 123/573 |
| 3,990,421 | 11/1976 | Grainger | 123/572 |
| 4,269,607 | 5/1981 | Walker | 123/573 |

FOREIGN PATENT DOCUMENTS

| | | | |
|---|---|---|---|
| 431702 | 7/1926 | Fed. Rep. of Germany | 123/572 |

*Primary Examiner*—Ronald H. Lazarus
*Attorney, Agent, or Firm*—Robert S. Smith

[57] ABSTRACT

Apparatus for increasing the life of an internal combustion engine, which includes apparatus for closing air inlets to the associated engine, a chamber having a desiccant disposed therein, and fluid communication apparatus connecting the container to at least the crankcase during at least a part of the engine operating cycle.

12 Claims, 7 Drawing Figures

CONTAMINATION CONTROL APPARATUS

This application is a continuation of application Ser. No. 551,360 filed Nov. 14, 1983, now abandoned.

RELATED APPLICATIONS

This invention is related to the invention shown and described in an application for a closed hydraulic system filed by the inventor herein concurrently with this application.

BACKGROUND OF THE INVENTION

The invention relates to combustion engines and particularly to contamination control apparatus for such engines.

The oil volume in engine crankcases varies with the operating mode of the system. Oil may be circulating through the system or temporarily stored in the components which are lubricated. The oil volume in the crankcases can change during normal operation. In the traditional internal combustion engine a combination air breather and fill-cap allows air to constantly enter and leave the crankcase reservoir to accommodate the variable volume.

One of the major problems with traditional systems is the contamination of the oil caused by the ambient air constantly entering and leaving the engine crankcase. The interior metal surface of the engine acts as an excellent air filter. As dirty ambient air enters the engine, the dirt particles are captured by the sticky oil surfaces within the engine. Then, air, which is relatively dust free, is expelled. This continual air breathing is the major source of oil contamination.

Air breathing causes another type of contamination that can be even more detrimental to the system, that is, moisture contamination. The water vapor pressure of the ambient air varies with many environmental factors. Whenever the temperature of the engine and crankcase is less than the dew point of the ambient air, condensation occurs. The condensed water then enters the oil system. Numerous problems can and do result from such open systems.

As a result of dirt and moisture contamination, the life of all moving engine parts such as pistons are greatly reduced. In addition, oil and filters must be changed frequently. Positive crankcase ventilation systems reduce contamination problems.

An object of this invention is to provide a simple, safe, inexpensive and effective contamination control device for all new and existing automobile and other engines.

SUMMARY OF THE INVENTION

The foregoing objects and other objects and advantages which shall become apparent from the detailed description of the preferred embodiment are attained in apparatus for increasing the life of an internal combustion engine, which in some forms of the invention includes means for closing air inlets to an associated engine, a chamber having a desiccant disposed therein, and fluid communication means connecting the container to at least one combustion chamber and/or the crankcase of the associated engine during at least a part of the operating cycle thereof.

The container may be disposed, for example, in fluid communication with the intake manifold of the associated engine. The container may be disposed proximate to a source of heat which may be the exhaust manifold of the associated engine. The means for fluid coupling may include valve means for selectively opening the means for fluid communication to the atmosphere. The valve may concurrently interrupt fluid communication between the associated engine and the container. The valve may be a three-way valve solenoid or diaphragm operated valve.

BRIEF DESCRIPTION OF THE ACCOMPANYING DRAWING

The invention will be better understood by reference to the accompanying drawing in which.

DESCRIPTION OF THE PREFERRED EMBODIMENT

Figure 1:
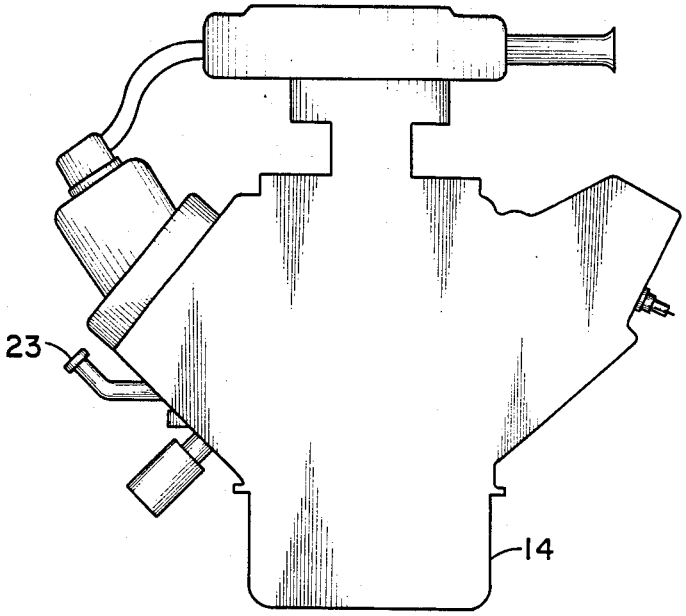
FIG. 1 is a schematic view of a conventional automobile showing the elements before installation of a second embodiment.

Referring to FIG. 1, there is shown a conventional internal combustion engine which includes an oil filler 23 and a crankcase 14.

Figure 2:
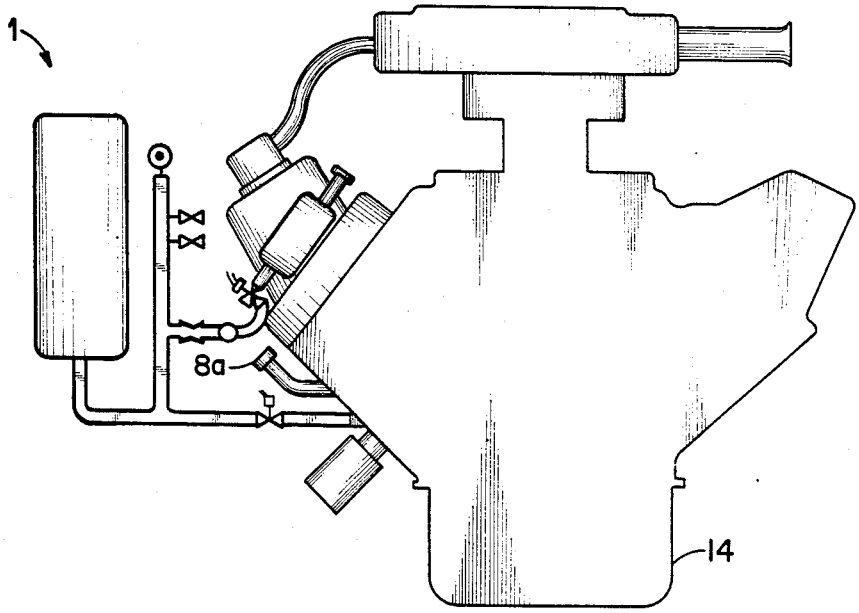
FIG. 2 is a schematic view of the automobile engine shown in FIG. 1 with a first embodiment of the contamination control apparatus in accordance with the invention installed, shown when the engine is "off".
Figure 3:
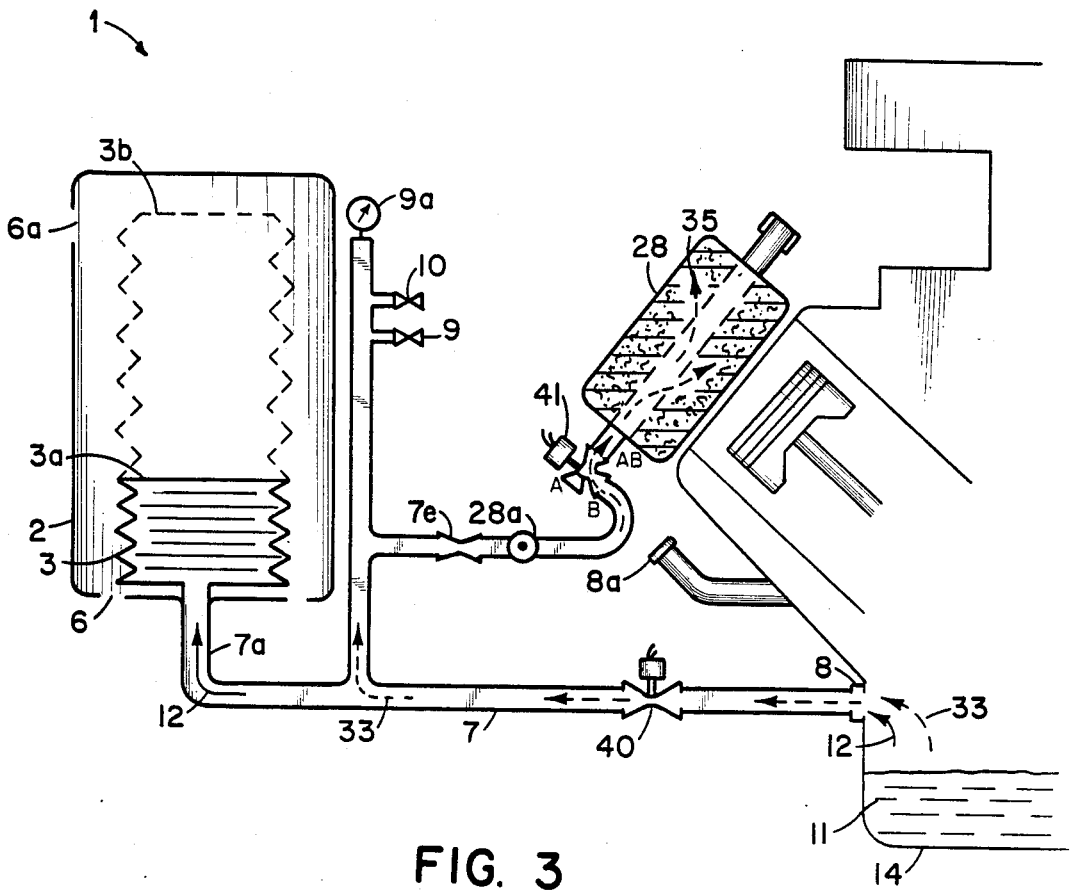
FIG. 3 is an enlarged schematic view of the contamination control apparatus of FIG. 2 again with the engine "off".
Figure 4:
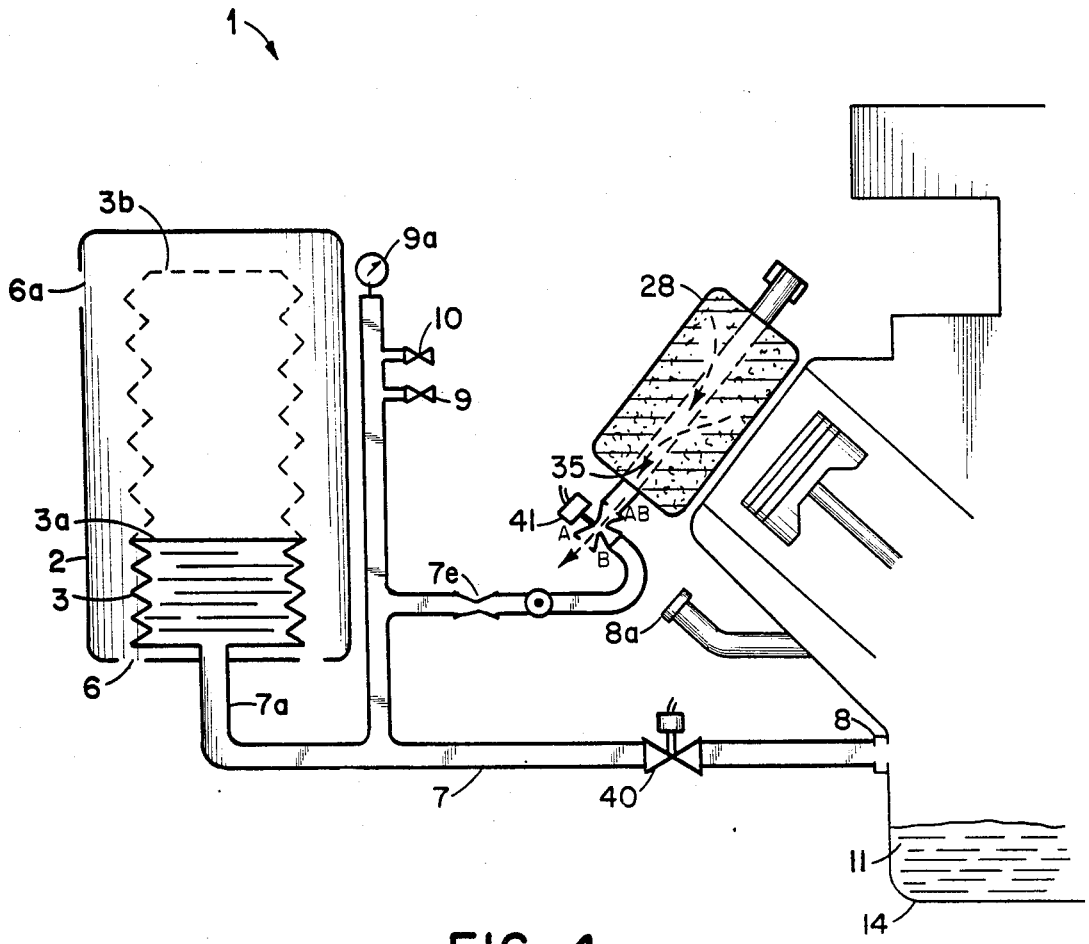
FIG. 4, is a view similar to FIG. 3, but with the engine "on".

Referring now to FIGS. 2–4, there is shown a first embodiment of a contamination control apparatus which includes a system automatic two-way control shut off 40, a three-way automatic control valve 41, a pressure relief valve 10, a vacuum relief valve 9, a compound pressure gauge 9A, a moisture indicator 28A, a desiccant dryer 28, the filler cap 23, a container 2 and an expandable variable volume bellows or bladder 3 which is part of a variable volume device 1. This device is positioned wherever space permits, as long as it is above the crankcase oil. This device is disclosed in greater detail in the present applicant's application for a closed hydraulic system filed concurrently with this application.

The variable volume device 1 changes volume without changing pressure. The operation of the system is primarily dependent upon the concept of having an open system during engine operation and automatic conversion to a closed system whenever the engine is off.

Considering the great differences in automobile engine design it becomes clear that the specific arrangement of the invention components will vary somewhat with different systems. All present systems have one main concept in common, i.e., they are all of fixed volume configuration. The total volume of the crank case 14 oil and air within the engine, oil lubrication system and associated components are fixed. When the traditional engine is off, ambient air can migrate to the engine interior by way of the air breather cap 23. The paths for air into the lubrication system varies tremendously with different engines. Engine openings communicating with the crankcase 14, such as the oil dip stick hole, should be air tight.

Water vapor, which is in the form of a gas, can travel independent from air flow in an attempt to equalize water vapor pressure. The present invention puts up a vapor barrier between the engine envelope and the ambient air. With the engine off, the system automatic two-way control valve 40 will open. The valve 40 is located in the conduit between the variable volume bellows 3 and the engine compartment, in the portion of the crankcase 14 above the oil 10. With the system valve 40 open, the system is converted from an open type to a closed type. The bellows 3 will vary in position to accommodate any expansion or contraction of the air and vapor within the engine. The variable volume bellows 3 is oversized to accommodate air and oil volume changes that occur due to extremes of temperature, both high and low.

Safety valves include the air pressure relief valve 10 and the vacuum relief valve 9. It may never be necessary to activate these valves 9, 10. However, if any operating condition should necessitate their use, the safety valves 9,10 would allow the system to temporarily revert back to an open system even though the engine is not running. Valve 7E is merely a service valve for the dryer 28 and is always open.

Where present systems allow dirty ambient air to enter and leave the reservoir, this system allows the dirty moisture laden ambient air to enter only that space between a container shell 2 and the bellows 3. The engine and oil are thereby kept clean and free from dirt and moisture. The system will work equally well for any weather condition be it hot and dry, cold and wet, rainy or foggy. In addition, when the engine is off, for example, at night, the effects of moisture vapor pressure migration are completely eliminated even though moisture vapor pressure migration can occur even without extensive air movement. With this invention, the bellows or bladder 3 acts as a vapor barrier. If the system is initially dry and kept moisture free, then there will be no moisture related contamination problems.

The contamination control system includes a desiccant dryer 28 that constantly removes any moisture from the air within the interior of the engine and the oil distribution system whenever the engine is off. The desiccant dryer 28 is separated from the air within the engine by the automatic three-way control valve 41. This valve 41 connects the engine and the desiccant dryer 28 whenever the engine is off and closes the connection to ambient air. Whenever the engine is running, the connection between the engine and the desiccant dryer 28 is closed and the connection between the desiccant dryer 28 and ambient air is open. The desiccant 28 is installed directly on a portion of the engine that becomes hot when the engine is running, such as the exhaust manifold.

When the engine is running and the desiccant dryer 28 is heated, the moisture that it has removed and captured is then driven out of the desiccant dryer 28 and is expelled to the ambient air. The desiccant dryer 28 is therefore automatically dried every time the engine is turned on. When the engine is turned off, the valve connections are reversed, and the desiccant dryer 28 is ready to extract and capture any moisture within the engine.

The moisture indicator 28A on the conduit shows whether or not the interior of the engine system is dry and free from water moisture. If moisture is indicated, then the bellows 3 and the desiccant dryer 28 are checked to see if either one is defective.

The compound pressure gauge 9A with a range of plus and minus 4 inches of water is connected to the conduit tube 25. This also indicates any system deficiency. For example, if there is no change in the interior closed system pressure when the engine is off, then the bellows 3 may be defective.

Figure 5:
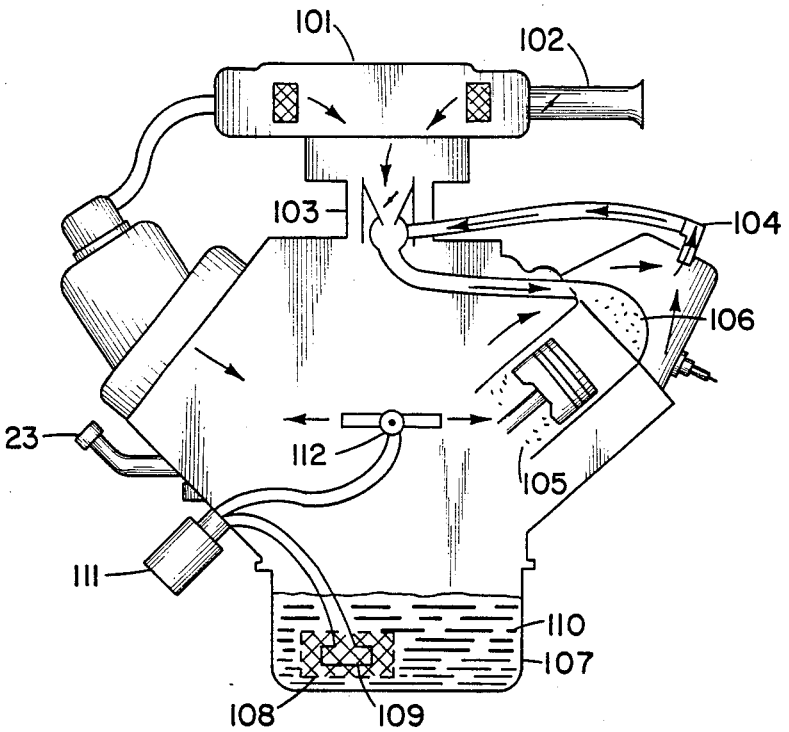
FIG. 5 is another schematic view of a conventional automobile engine showing portions of the apparatus before installation of a second embodiment of the apparatus in accordance with the invention
Figure 6:
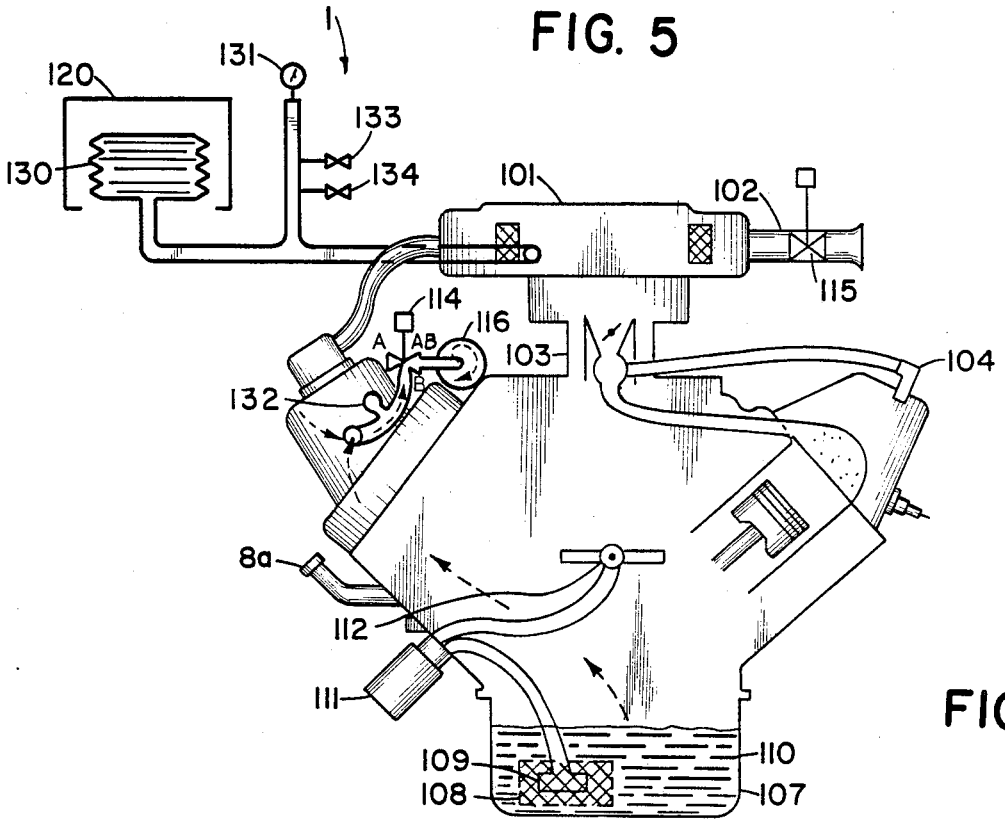
FIG. 6 is a schematic view similar to FIG. 5 showing the second embodiment installed with the engine "off".
Figure 7:
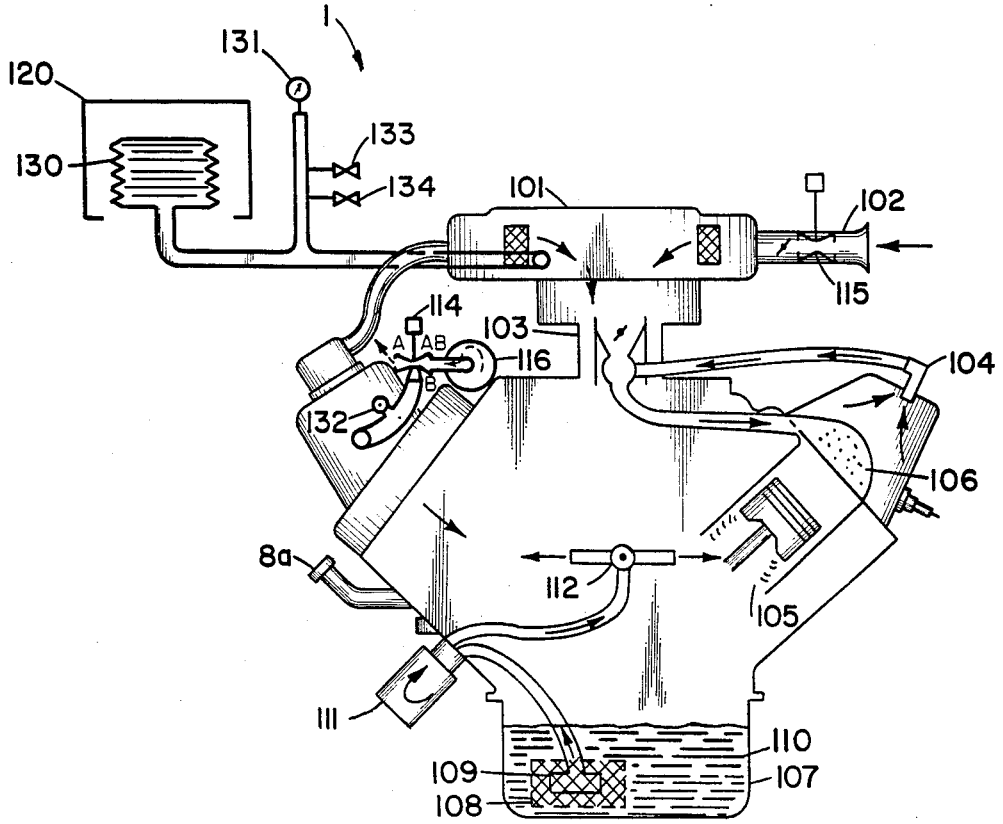
FIG. 7 is similar to FIG. 6 but with engine "on".

Referring now to FIGS. 5, 6, and 7, there is shown in FIG. 5 a schematic of a conventional internal combustion engine which includes an air cleaner 101, an air inlet duct 102, a carburetor 103, a positive crankcase ventilation valve 104, and a combustion chamber 106. The combustion chamber 106 is defined, in part, by a pistons having piston rings which allow some flow by gases 105 to pass into the inner cavity of the engine block and to the crankcase 107, in which is located a screen 108, an oil pump 109, and oil 110. The outlet of the oil pump 109 is connected to an oil filter 111, which is in turn connected with an oil distribution system 112.

Referring now, more specifically to FIGS. 6 and 7, there is shown the second embodiment respectively with the engine off and with the engine on. The apparatus has a three-way valve 114, which may be either solenoid or diaphragm actuated and which, with the engine off, connects the intake manifold or alternatively the rocker arm area with a desiccant containing chamber 16. A variable volume device 120, having a housing surrounding an elastic expandable bellows 130, is disposed in fluid communication with the interior of the air cleaner 101. The conduit coupling the variable volume device 120 to the air cleaner 101 has connected to it a compound pressure gauge 131, a moisture indicator 132, a safety pressure relief valve 133 which may, for example, be set at $\frac{1}{3}$ psi, and a safety vacuum relief valve 134 which may, for example, be set at $\frac{1}{3}$ psi also. Connected to the air filter 101 is the inlet duct 102 having a valve 115, which may be solenoid or diaphragm operated.

In operation, when the engine is off the valve 115 closes. Other engine openings such as the oil dip stick hole are also sealed in the manner which is now generally utilized. The three-way valve 114 moves to allow fluid communication between the desiccant in the container 116 and the intake manifold so that the region above the pistons is kept dry.

When the engine is turned on, the three-way valve 114 connects the desicant filled container 116 to ambient and the heat from the adjoining exhaust manifold causes water to be driven from the desiccant and out to the ambient. Concurrently, with the movement of the three-way valve 114, the valve 115 opens to allow passage of air in through the duct 102 to the air cleaner 101 and down to the intake manifold through the carburetor 103. Thus, normal engine operation is attained. As in the embodiments of FIGS. 2–4, the variable volume device 120 functions to avoid the addition of contaminated and moisture laden air into the inside of the engine.

The advantages of the contamination control apparatus in accordance with the invention are numerous. The invention virtually eliminates contamination from dust and moisture via air breathing along with the resultant problems whenever the engine is off. Equipment life is greatly extended, and the frequency of oil filter and oil changes will be dramatically reduced.

Once the engine and lubrication systems are fitted with this apparatus, the system changes from an open system to a closed system. Initially, only a small amount of contamination enters the reservoir through the original air. Since no more air is allowed to enter this closed system, the air within the reservoir stays clean. As long as the engine is in the off mode, no further contamination occurs.

The oil volume varies slightly due to the system mode of operation and temperature changes. The major problem is caused by a great change in air volume as the temperature changes. That is when the variable volume features of this invention come into play. When the air volume above the crankcase 14 oil varies, the flexible portion of the device repositions itself.

The potential applications of this invention relate to any open system wherein fluid is stored in the reservoir. Examples include automobile and diesel engines, automobile transmissions, lawn mowers, other internal combustion engines, and chemical process sytems where makeup air is used to accommodate variable volume within a tank.

The apparatus in accordance with the invention will, in effect, convert the traditional crankcase oil system from an open to a closed system whenever the engine is off. It also dries and removes any water or moisture within the system.

Although it is desirable to close off the crankcase and the inside of the engine block to minimize contamination, it is not as essential as in the closed hydraulic system apparatus.

The invention has been described with reference to its illustrated preferred embodiments. Persons skilled in the art of constructing contamination control apparatus may, upon exposure to the teachings herein, conceive variations in the mechanical development of the components therein. Such variations are deemed to be encompassed by the disclosure, the invention being delimited only by the appended claims.

Having thus described my invention, I claim:

1. An internal combustion engine, which comprises:

an engine having a crankcase;

a container for collecting crankcase vapors, said containers having a desiccant disposed therein, said communication alternately between (1) a first position to said engine; and means for providing fluid communication alternately between (1) a first position coupling said container to at least a part of said crankcase of said engine when said engine is not operating in order to supply a crankcase vapors to the container and (2) a second position coupling said container to ambient when said engine is operating, said desiccant absorbing crankcase vapors when said engine is not running and releasing the crankcase vapors previously absorbed to the atmosphere when said engine is not running whereby in order that crankcase vapors contained therein are released by the heated desiccant to the atmosphere.

2. The apparatus as described in claim 1, wherein:

said hollow interior portions of said engine include a crankcase wherein said crankcase has an upper and a lower part and said means for providing fluid communication couples said container to said upper part of said crankcase in said first position.

3. The apparatus as described in claim 1, wherein:

said apparatus includes means for regenerating said desiccant, said means for regenerating including positioning said container proximate to a source of heat.

4. The apparatus as described in claim 3, wherein:

said source of heat is said exhaust manifold of engine.

5. The apparatus as described in claim 4, wherein:

said means for providing fluid communication includes at least one valve.

6. The apparatus as described in claim 1, wherein:

said valve operates to substantially concurrently open to ambient and interrupt fluid communication between said container and said crankcase.

7. The apparatus as described in claim 6, wherein:

said valve is a three-way valve.

8. The apparatus as described in claim 5, wherein:

said valve is a solenoid operated valve.

9. The apparatus as described in claim 8, wherein:

said valve is a diaphragm operated valve.

10. The apparatus as described in claim 1, further including:

an elastic fluid impervious chamber and means for sealing said elastic fluid impervious chamber with the interior thereof in fluid communication with the inside of said hollow interior portions of said engine; and a housing disposed in spaced relationship around said elastic fluid impervious chamber with at least portions of the space intermediate said housing and said elastic fluid impervious chamber being vented to ambient.

11. The apparatus as described in claim 1, further including:

a pressure release means.

12. The apparatus as described in claim 1, further including:

vacuum release means.

* * * * *